United States Patent [19]

Haythornthwaite

[11] Patent Number: 4,613,138

[45] Date of Patent: Sep. 23, 1986

[54] TENNIS RACQUET WITH FLEXIBLE MEMBRANE FRAME

[76] Inventor: James Haythornthwaite, 567 Main Road, Hudson, Quebec, Canada, J0P 1J0

[21] Appl. No.: 628,994

[22] Filed: Jul. 9, 1984

[51] Int. Cl.[4] ..... A63B 51/12

[52] U.S. Cl. ..... 273/73 E; 273/73 D

[58] Field of Search ..... 273/73 R, 73 C, 73 D, 273/73 E, 73 J, 73 G, 73 L

[56] References Cited

U.S. PATENT DOCUMENTS

| | | | |
|---|---|---|---|
| 1,476,906 | 12/1923 | Santa Maria | 273/73 E |
| 3,724,850 | 4/1973 | Stevens | 273/73 E |
| 4,013,290 | 3/1977 | Stevens | 273/73 E |
| 4,118,029 | 10/1978 | Septier | 273/73 E |
| 4,163,553 | 8/1979 | Renfro | 273/73 D |

FOREIGN PATENT DOCUMENTS

| | | | |
|---|---|---|---|
| 2513567 | 10/1976 | Fed. Rep. of Germany | 273/73 E |
| 784057 | 4/1935 | France | 273/73 E |
| 81/03431 | 12/1981 | Int'l Pat. Institute | 273/73 R |
| 22409 | 2/1930 | Netherlands | 273/73 E |
| 5358 | of 1889 | United Kingdom | 273/73 E |
| 234021 | 2/1925 | United Kingdom | 273/73 E |
| 2029241 | 3/1980 | United Kingdom | 273/73 E |
| 2056288 | 3/1981 | United Kingdom | 273/73 D |

*Primary Examiner*—Richard C. Pinkham
*Assistant Examiner*—Matthew L. Schneider
*Attorney, Agent, or Firm*—Fleit, Jacobson, Cohn & Price

[57] ABSTRACT

A tennis racquet which utilizes an energy input system is disclosed. The racquet head employs a flexible membrane which is held in place by membrane carriers secured to the interior of the head and to which the strings are attached. This membrane extends into the handle portion of the racquet where it is firmly anchored to a tensioning/energy input, storage and release device which in the preferred embodiment comprises a spring assembly. By adjusting this spring assembly, the player can dictate the amount of spring energy to be applied to an object striking the strings and thus determine the object's release speed and its dwell time on the racquet. Because the strings are not attached directly to the frame, the effective striking area of the racquet is enlarged.

13 Claims, 3 Drawing Figures

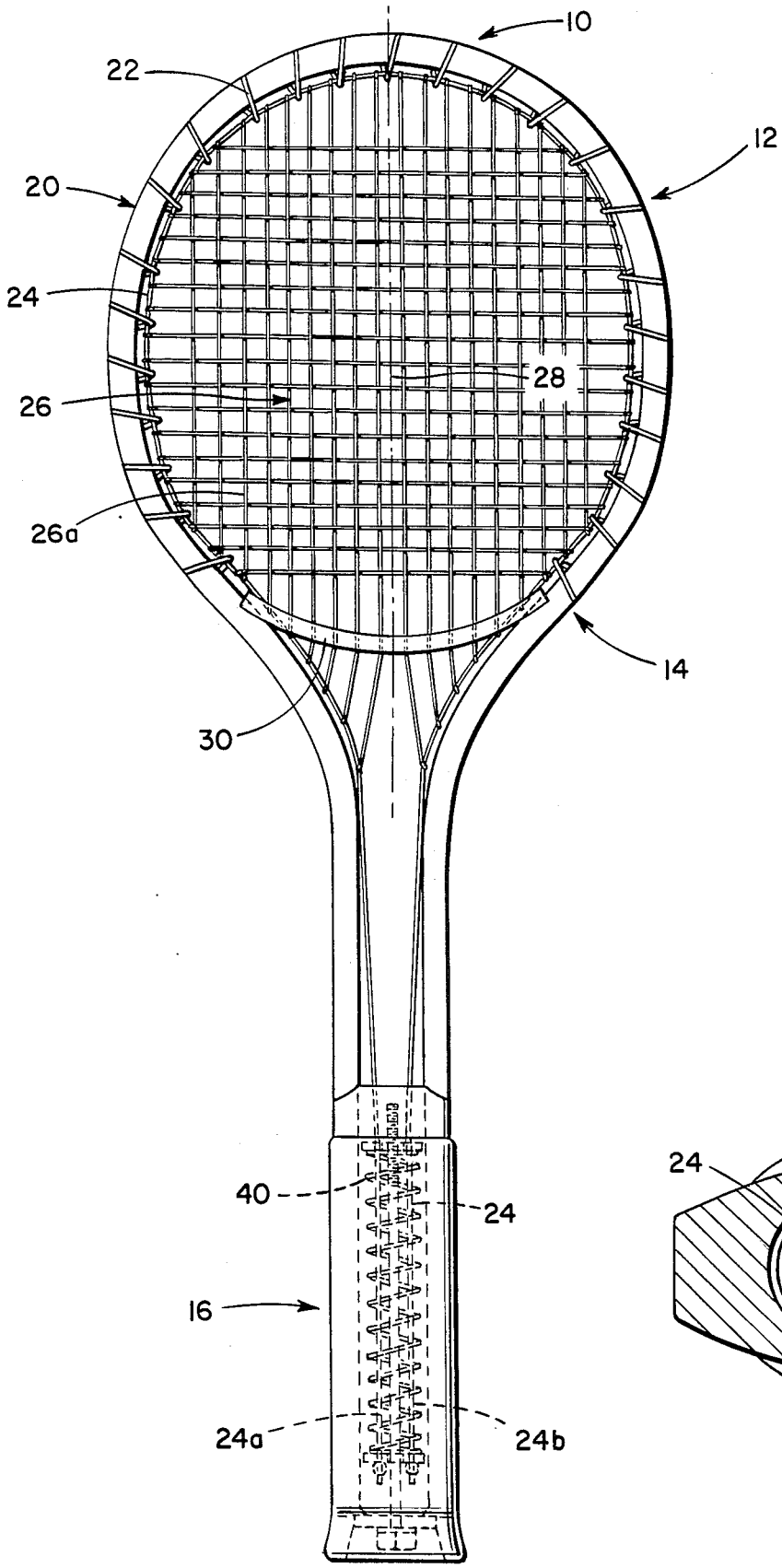
FIG. 1
FIG. 3
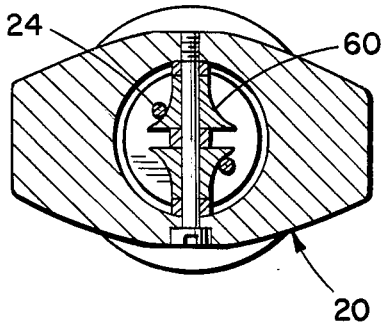

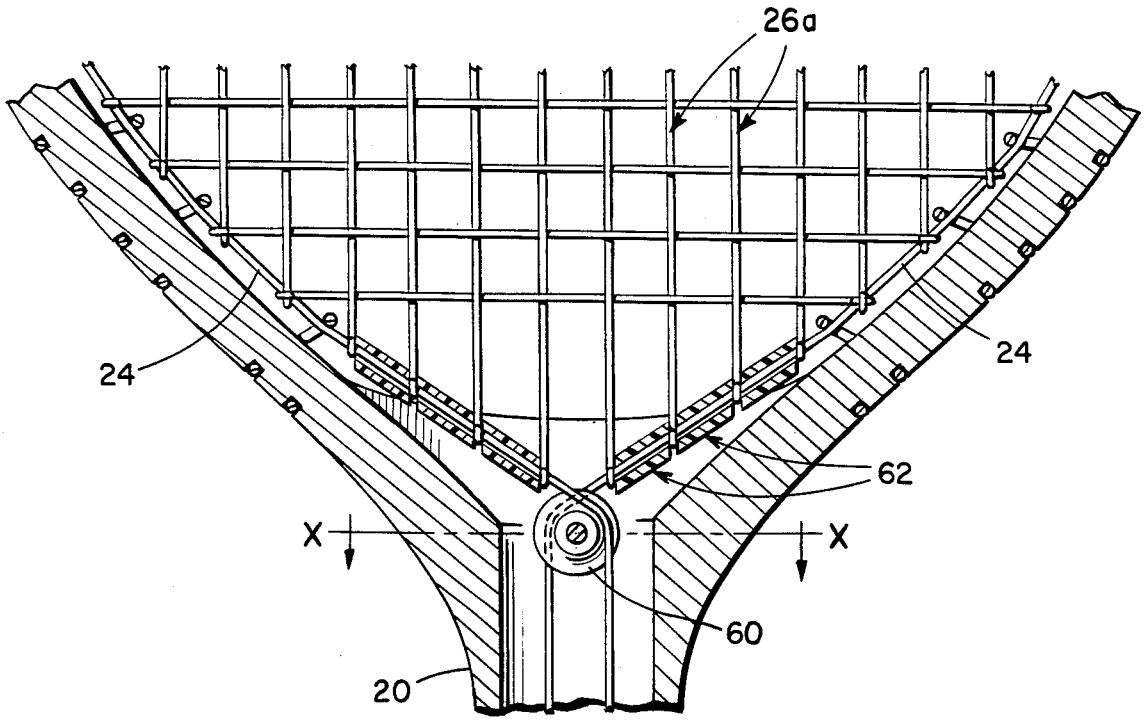
FIG. 2
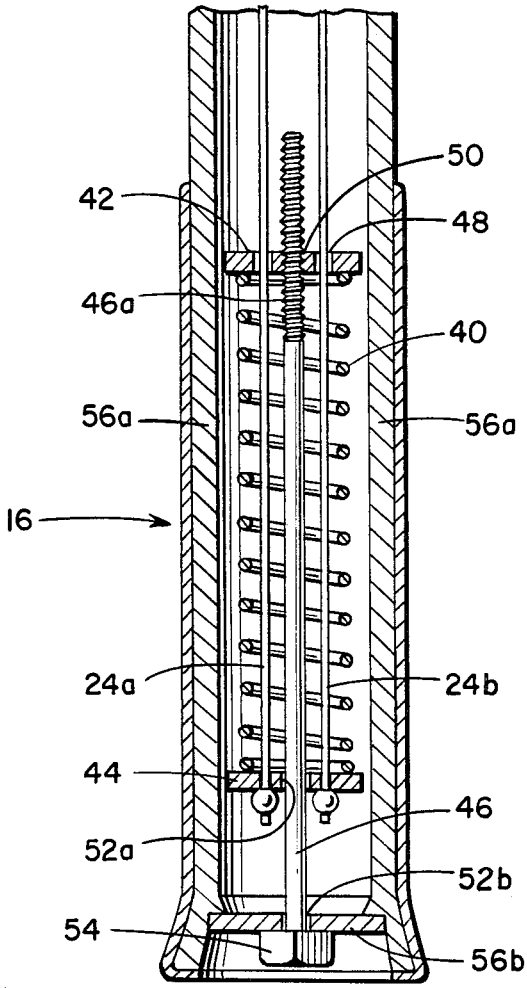

TENNIS RACQUET WITH FLEXIBLE MEMBRANE FRAME

BACKGROUND OF THE INVENTION

This invention relates to a sports racquet incorporating a flexible membrane frame.

There are many tennis racquets existing today which provide a means for controlling the tension of the racquet strings such that the strings maintain a certain degree of tension during the operation of the racquet. Although these racquets attain their primary objective, they lack other important attributes. For example, they employ no effective means, apart from predetermined frame structures or string tension, of absorbing, storing and releasing energy during play. This controlled energy is capable of varying the release speed of the ball and its dwell time on the racquet. Additionally, these racquets are limited in their effectiveness by the size of their operative striking area ("sweet spot").

Accordingly, it is an object of this invention to provide a tennis racquet which employs an energy input, storage and release system for adjusting the release speed of the ball from the racquet.

Another object of the present invention is to provide a racquet which presents the ability to adjust the dwell time of the ball on the racquet.

Yet another object of the present invention is to provide a racquet which promotes longer string life.

Another object of the present invention is to provide a racquet whose playing effect is not dependent on the frame construction in either materials, shape or size.

Still another object of the present invention is to provide a racquet with a larger effective striking area.

SUMMARY OF THE INVENTION

The foregoing and other objects of the invention are achieved by providing a novel tennis racquet which utilizes an energy input, storage and release system. The racquet head employs a flexible membrane which is held in place by membrane carriers secured to the interior of the head and to which the strings are attached. This membrane extends into the handle portion of the racquet where it firmly is anchored to a tensioning/energy input device, which in the preferred embodiment comprises a spring assembly. By adjusting the spring assembly, the player can dictate the amount of spring energy to be applied to an object striking the strings and thus determine the object's release speed and its dwell time on the racquet. Because the strings are not attached directly to the frame, the effective striking area of the racquet is enlarged.

BRIEF DESCRIPTION OF THE DRAWINGS

FIG. 1 is a plan view of the racquet of the present invention.

FIG. 2 is an enlarged sectional view of the preferred embodiment of the racquet handle portion.

FIG. 3 is a cross-sectional view taken along line X—X of FIG. 2.

DESCRIPTION OF THE PREFERRED EMBODIMENT

Referring now to FIG. 1, the tennis racquet of the present invention is shown generally at 10. Racquet 10 comprises a head portion 12, a neck portion 14, and a handle portion 16. Head portion 12 utilizes a flexible membrane 24 which holds the strings 26*a* in place and extends into the handle portion 16.

Head portion 12 is defined by a racquet frame 20 which has a plurality of membrane carriers 22 attached thereto. Extending inwardly from frame 20, these carriers 22 are in spaced relationship to one another and form loops for supporting flexible membrane 24. Membrane 24 passes through each carrier 22, both ends 24*a*, 24*b* of membrane 24 entering into handle portion 16. This membrane 24 is preferably made from non-stretch materials such as wire cable, carbon fibre or other molecular engineered structures.

Attached to the membrane 24 and forming a net 26 in the central opening 28 defined by the frame 20 are strings 26*a*. The net 26 may comprise a plurality of individual strings 26*a*, each string 26*a* spanning the opening 28 in either the horizontal, vertical or diagonal direction and being securely attached to membrane 24. Alternately, the net 26 may comprise a small number of strings 26*a* continuously threaded to the membrane 24, or even a single string.

In one embodiment, neck portion 14 includes a string guide 30 located at the base of racquet frame 20. The string guide 30 is attached to membrane 24 and is used to guide the vertical strings 26*a* in the middle of opening 28 into position for attachment or threading to membrane 24. This guide 30 ensures that the strings 26*a* form a symmetrical pattern in opening 28 and defines the lower boundary of the net 26 striking surface.

Alternately, racquet 10 may employ a guide assembly 60, as illustrated in FIG. 2, in place of string guide 30. Guide assembly 60, which is anchored to frame 20 in neck portion 14, provides a cross-over point for membrane 24, thereby allowing the vertical strings 26*a* to be connected directly to membrane 24. In addition, string separators 62 may be used on membrane 24 to eliminate the potential for lateral movement of strings 26*a* on membrane 24.

Guide assembly 60, shown more clearly in FIG. 3, utilizes cross-over guides 62 which function to separate the ends 24*a* and 24*b* of membrane 24 as they pass into handle 16 and keep membrane 24 in place. Guides 62 may take several forms including a hinge, a wheel or a plate with apertures therein.

Returning to FIG. 2, the handle portion 16 of racquet 10 is shown to be hollow, having sidewalls 56*a* and a bottom wall 56*b*. Located within handle 16 is a spring 40 which is compressed between a top plate 42 and a bottom plate 44, both of which are slideably positioned therein. Both ends 24*a*, 24*b* of membrane 24 extend down into handle 16 on either side thereof, passing through guide slots 48 in top plate 42 and the interior of spring 40, finally being secured in bottom plate 44.

Top plate 42 has an aperture 50 therein which is threaded to mate with a cooperatively threaded bolt 46. Bottom plate 44 in bottom wall 56*b* also have therein central apertures 52*a* and 52*b*, respectively. Apertures 52*a*, 52*b* are not threaded. Extending through aperture 52*b* of bottom wall 56*b*, aperture 52*a* of bottom plate 44, and threaded aperture 50 of top plate 42 is a bolt 46 for adjusting the tension of membrane 24. At the bottom of bolt 46 is a knurled adjusting knob 54 which rests against the outside of bottom wall 56*b*. The top portion 46*a* of bolt 46 is threaded so as to cooperate with threaded aperture 50 in top plate 42. Thus, by engaging top plate 42 through threaded aperture 50, bolt 46 holds top plate 42, and thereby spring 40 and bottom plate 44, in position within handle 16.

Referring now to FIGS. 1 and 2, racquet 10 is shown in readiness for use. When the user swings racquet 10 and strikes a ball (not shown), net 26 will deform in accordance with the impact, thereby straining membrane 24 and pulling both ends 24*a*, 24*b* of membrane 24, which are secured to bottom plate 44, in the direction of arrow I. Because top plate 42 is held in place by bolt 46, spring 40 which is normally held under compression is compressed further as bottom plate 44 responds to the movement of membrane ends 24*a*, 24*b*. During this time, the ball remains on the surface of net 26. Once the ball has compressed the spring by virtue of its force on the net, the spring 40 will return to its original, less compressed position by pushing bottom plate 44 downwardly, thereby pulling membrane 24 back into its original position. This action supplies additional spring energy input to the net 26 in returning it to its pre-impact position. The ball, previously on net 26, comes off the racquet at a greater speed than could otherwise be achieved with normal stringing techniques by virtue of the additional spring energy provided by spring 40 through membrane 24.

Because bolt 46 is threadly engaged with top plate 42, spring 40 may be adjusted, and its repose compression altered, by turning adjusting knob 54. By turning knob 54 so as to move top plate 42 downwardly in the direction of bottom wall 56*b*, bottom plate 44 will be urged in the same direction by spring 40. This additional spring force on bottom plate 44 serves to tighten membrane 24 and compress spring 40 somewhat, therefore tightening the net 26 and permitting less compression of spring 40 on impact. As a result, the ball's dwell time on net 26 will be decreased and the amount of spring energy which can be transmitted to net 26 will be increased.

Alternately, by moving top plate 42 in the opposite direction (i.e., toward neck portion 14), spring 40 will be under less compression when in its rest position. With spring 40 being so extended, bottom plate 44 will be permitted to move in the same direction as top plate 42. This movement will loosen membrane 24 and provide for a greater compression of spring 40 upon impact. As a result, the ball's dwell time on net 26 will be increased and the amount of spring energy which can be transmitted to net 26 will be decreased. Although a spring 40 is used in the preferred embodiment to supply the energy input to net 26 and tension member 24, any other arrangement which achieves this result, such as a compression cylinder, may be used.

This racquet 10 and its operational characteristics carry several advantages over prior art racquets:

1. It provides the ability readily to change either the tension of membrane 24 or the type of string 26*a* so as to accommodate the user or the conditions of play;

2. It provides the ability to achieve varying dwell times on the racquet 10;

3. It maintains the strings 26*a* in a constant tension which will not vary due to wear or playing conditions;

4. It enlarges the effective striking zone of net 26;

5. It lengthens the life of string 26*a* by reducing wear due to string movement relative to one another.

6. The desired racquet action is independent of frame size or materials, as well as string types or tensions.

Although a particular embodiment of the present invention has been illustrated and described, it will be apparent to those skilled in the art that various changes and modifications can be made without departing from the spirit and scope of the present invention. It therefore is the intent to encompass within the appended claims all such changes and modifications that fall within the scope of the present invention.

What is claimed is:

1. A sports racquet for use in games such as tennis and the like, said racquet comprising:

a racquet frame having an annular head portion defining a central opening, said racquet further having an inner peripheral surface facing said central opening;

a handle portion; and a neck portion connecting said head portion and said handle portion;

a plurality of membrane carriers secured to said inner peripheral surface;

a flexible membrane passing through said membrane carriers and extending into said handle portion;

horizontal and vertical strings attached to said flexible membrane to space said strings away from said inner peripheral surface thereby enlarging the effective striking area of a grid pattern formed within said central opening by said strings; and tensioning means disposed in the region of said handle portion, said flexible membrane being secured to said tensioning means and said tensioning means adjusting the tension of said flexible membrane by absorbing, storing and releasing energy during engagement and release of a ball during play, said tensioning means including a biasing means for variably tensioning said flexible membrane, said biasing means being compressed when a ball contacts said strings to absorb energy, said biasing means storing energy during a dwell time of said ball on said strings and said biasing means expanding when the ball is released from said strings to release said stored energy.

2. A racquet as defined in claim 1, wherein said flexible membrane is firmly anchored to said tensioning means.

3. A racquet as defined in claim 1, wherein said neck portion includes a string guide connected to said flexible membrane, a portion of said vertical strings being threaded through said string guide.

4. A racquet as defined in claim 1, wherein said neck portion includes a membrane guide assembly for providing a cross-over point for the membrane, said guide assembly anchored to the racquet.

5. A racquet as defined in claim 1, wherein said handle portion is hollow and includes side walls and a bottom wall.

6. A racquet as defined in claim 5, wherein said biasing means includes a spring, top and bottom spring plates connected to said spring and slideably positioned within said handle portion, and an adjusting bolt having top and bottom portions and said bolt extending through said spring, said top portion being connected to said top plate and said bottom portion being connected to said handle bottom wall.

7. A racquet as defined in claim 6, wherein said flexible membrane is firmly anchored to said bottom plate, and wherein said top plate has access slots for passage of said flexible membrane.

8. A racquet as defined in claim 7, wherein said bottom wall and said top and bottom plates each has an aperture for passage of said adjusting bolt, the aperture in said top plate being threaded; said bolt has an adjusting knob disposed on said bottom portion, said top portion being threaded; and, said bolt passing through the aperture in said bottom wall with said adjusting knob resting against said bottom wall, and said threaded top portion of said bolt passing through the aperture in said bottom plate and threadingly engaging the threaded aperture of said top plate, the position of said top plate being adjustable by turning said adjusting knob.

9. A racquet as defined in claim 8, wherein said spring is in a compression state when fully in repose.

10. A sports racquet comprising:

a frame including a head portion defining a central opening having an inner peripheral surface facing said central opening, and a handle portion;

a flexible membrane;

connecting means attached to said inner peripheral surface for connecting said flexible membrane to said head portion;

strings connected to said flexible membrane to space said strings away from said inner peripheral surface, said strings forming a grid pattern; and tensioning means connected to said handle portion and said flexible membrane being connected to said tensioning means, said tensioning means including biasing means for biasing said tensioning means, said tensioning means being biased for compression when a ball strikes said strings and for expansion when a ball leaves said strings to allow said flexible membrane to return to a pre-impact position occupied prior to said ball striking said strings, said biasing means adding bias energy to said strings in returning said flexible membrane to its pre-impact position by absorbing, storing and releasing energy during engagement and release of a ball by said strings.

11. A sports racquet as claimed in claim 10, wherein said biasing means is in a compression state when in respose.

12. A sports racquet as claimed in claim 10, wherein the bias of said tensioning means is adjustable.

13. A sports racquet as claimed in claim 10, wherein said flexible membrane is made of a non-stretchable material.

* * * * *